US006099279A

United States Patent [19]

Kohsokabe et al.

[11] Patent Number: 6,099,279

[45] Date of Patent: Aug. 8, 2000

[54] DISPLACEMENT FLUID MACHINE

[75] Inventors: Hirokatsu Kohsokabe, Ibaraki-ken; Masahiro Takebayashi, Tsuchiura; Shunichi Mitsuya, Ibaraki-ken; Hiroaki Hata, Tochigi-ken; Kenichi Oshima, Tochigi-ken; Yasuhiro Oshima, Tochigi-ken, all of Japan

[73] Assignee: Hitachi, Ltd., Tokyo, Japan

[21] Appl. No.: 08/932,918

[22] Filed: Sep. 18, 1997

[30] Foreign Application Priority Data

Sep. 20, 1996 [JP] Japan ..... 8-249761

[51] Int. Cl.[7] ..... F01C 1/04; F01C 19/08; F01C 21/04

[52] U.S. Cl. ..... 418/61.1; 418/76; 418/77; 418/142

[58] Field of Search ..... 418/55.1, 55.2, 418/55.4, 61.1, 76, 77, 142

[56] References Cited

U.S. PATENT DOCUMENTS

| | | | |
|---|---|---|---|
| 385,832 | 7/1888 | Allyn . | |
| 406,099 | 7/1889 | Johnson . | |
| 592,788 | 11/1897 | Karavodin | 418/76 |
| 801,182 | 10/1905 | Creux . | |
| 940,817 | 11/1909 | McLean et al. . | |
| 1,451,859 | 4/1923 | Balcker | 418/76 |
| 1,701,792 | 2/1929 | Nelson | 418/77 |
| 2,112,890 | 4/1938 | Gunn . | |
| 3,307,525 | 3/1967 | McClure | 418/142 |
| 5,316,455 | 5/1994 | Yoshimura et al. | 418/77 |
| 5,681,156 | 10/1997 | Rapp | 418/61.1 |

FOREIGN PATENT DOCUMENTS

| | | | |
|---|---|---|---|
| 55-23353 | 2/1980 | Japan | 418/61.1 |
| 1-227890 | 9/1989 | Japan | 418/76 |
| 4-342892 | 11/1992 | Japan | 418/76 |
| 5-202869 | 8/1993 | Japan . | |
| 6-280758 | 10/1994 | Japan . | |
| 947382 | 1/1964 | United Kingdom | 418/77 |

*Primary Examiner*—John J. Vrablik
*Attorney, Agent, or Firm*—Antonelli, Terry, Stout & Kraus, LLP

[57] ABSTRACT

An orbiting fluid machine has a feature that the speed of sliding movement is low, while vibrations are small, its performance is lowered when the rotational speed becomes high, and this problem is resolved by the following structure. A displacement fluid machine includes a displacer making an orbital motion within a casing into which a working fluid is drawn, thereby drawing and discharging the working fluid, in which an oil retaining mechanism or a seal mechanism is provided at each of opposite end surfaces of the displacer. This results that, axial gaps at the end surfaces of the displacer are effectively sealed so as to reduce a leakage loss, thereby achieving a high performance and a high reliability.

4 Claims, 16 Drawing Sheets

DISPLACEMENT FLUID MACHINE

BACKGROUND OF THE INVENTION

1. Field of the Invention

This invention relates to a high-efficiency displacement fluid machine in which a displacer for moving a working fluid revolves, i.e. makes an orbital motion, with a substantially constant radius relative to the cylinder, into which the working fluid has been drawn, without rotation, thereby conveying the working fluid.

2. Description of the Related Art

As displacement-type fluid machines, there have been long known a reciprocating fluid machine in which a piston is reciprocally moved repeatedly in a cylinder to move a working fluid, a rotary (rolling piston-type) fluid machine in which a cylindrical piston makes an eccentric rotary motion in a cylinder to move a working fluid, and a scroll fluid machine in which a pair of stationary and orbiting scrolls, each having a wrap of a volute configuration formed perpendicularly on an end plate, are engaged with each other, and a working fluid is moved by revolving the orbiting scroll.

The reciprocating fluid machine has an advantage that it can be easily manufactured, and is inexpensive since its construction is simple, but a stroke from the end of the suction to the end of the discharge is as short as 180° in terms of an angle of rotation of a shaft, and the flow velocity during the discharge stroke becomes high, which invites a problem that the performance is lowered because of an increased pressure loss. And besides, since the motion for reciprocating the piston is required, the rotation shaft system can not be perfectly balanced, which invites a problem that large vibrations and noises are produced.

In the rotary fluid machine, a stroke from the end of the suction to the end of the discharge is 360° in terms of an angle of rotation of a shaft, and therefore the problem that a pressure loss increases during the discharge stroke is less serious as compared with the reciprocating fluid machine. However, a fluid is discharged for each rotation of the shaft, and therefore a variation in a gas compression torque is relatively large, which invites vibration and noise problems as in the reciprocating fluid machine.

Various proposals have heretofore been made with respect to a displacement fluid machine of the orbital motion-type (hereinafter referred to as "orbiting fluid machine"). U.S. Pat. No. 385,832 discloses a pump in which a cylindrical displacer makes an orbital motion within a casing, thereby conveying a working fluid. A construction, in which this displacer is formed into a multi-cylinder type, is also disclosed in U.S. Pat. Nos. 406,099 and 940,817. U.S. Pat. No. 801,182 discloses a machine in which a working fluid is compressed not by such a cylindrical-type displacer but by a volute-type displacer. This is an original form of a fluid machine now called "scroll fluid machine", and is a kind of orbiting fluid machine, and these machines have been advanced to such an extent as to form an independent stream.

In such a scroll fluid machine, a stroke from the end of the suction to the end of the discharge is as long as more than 360° in terms of an angle of rotation of a shaft (usually, about 900° in a scroll fluid machine put into practical use for air-conditioning purposes), and therefore a pressure loss during the discharge stroke is small, and besides, generally, a plurality of operation chambers are formed, and therefore there is achieved an advantage that a variation in a gas compression torque is small, so that vibrations and noises are small. However, it is necessary to control a clearance between the volute wraps, engaged with each other, as well as a clearance between the end plate and the tip of the wrap, and therefore high-precision processing or working is needed, which invites a problem that the processing cost is high. And besides, since the stroke from the end of the suction to the end of the discharge is as long as more than 360° in terms of the rotational angle of the shaft, the time for the compression stroke is long, which invites a problem that an internal leakage increases.

Proposed in Japanese Patent Unexamined Publication No. 55-23353 (document 1) and U.S. Pat. No. 2,112,890 (document 2) are a kind of displacement-type fluid machines in which a displacer (orbiting piston) for moving a working fluid revolves, i.e. make an orbital motion, with a substantially constant radius relative to a cylinder, into which the working fluid has been drawn without rotation, thereby conveying the working fluid. The displacement fluid machine, proposed in these publications, comprises the piston of a generally radial shape having a plurality of portions (vanes) extending radially from its center, and the cylinder having a hollow portion similar in shape to the piston. The piston makes an orbital motion within the cylinder, thereby moving the working fluid. These fluid machines are so designed that a pressure pulsation of the working fluid can be reduced so as to reduce a variation in torque, but have not yet matured to a displacement fluid machine sufficiently suited for practical use.

In the structures, disclosed in the above documents 1 and 2, the rotation shaft system can be completely balanced, and therefore, vibrations are small, and also the speed of relative slip between the piston and the cylinder is low, so that a friction loss can be reduced to a relatively small value, which is an essentially advantageous feature for the orbiting fluid machine.

However, the stroke from the end of the suction to the end of the discharge in each of the operation chambers, formed by the plurality of vanes of the piston and the cylinder, is as short as about 180° in terms of the angle θ of rotation of the shaft (This is about a half of that of the rotary type, and is about the same as that of the reciprocating type), and therefore the flow velocity of the fluid becomes high during the discharge stroke, so that a pressure loss increases, which invites a problem that the performance is lowered.

And besides, in the fluid machine of this type, a rotation moment, which is produced as a reaction force of the compressed working fluid, and tends to rotate the displacer, is exerted on the displacer, and the vanes of the displacer receive this rotation moment. However, in the structure disclosed in the above documents 1 and 2, the compression operation chambers, formed during the stroke from the end of the suction to the end of the discharge, are disposed in a concentrated manner on one side of the drive shaft, and therefore the rotation moment, acting on the displacer, becomes excessive, so that the vanes are subjected to friction and wear, which invites a problem that the performance and reliability are affected.

Incidentally, taking this drawback into consideration, a fluid machine was actually prepared, and a test was conducted to determine the performance with respect to the rotational speed. As a result, there has been encountered a problem that the compression performance (considered equivalent to the pumping performance) is lowered when the rotational speed exceeds a certain value.

SUMMARY OF THE INVENTION

It is an object of this invention to provide a displacement fluid machine in which even when a rotational speed of this fluid machine is increased, its performance will not be lowered.

The above object has been achieved by a displacement fluid machine comprising a displacer and a cylinder which are provided between end plates, in which, when a center of the displacer and a center of the cylinder are aligned with each other, one space is formed by an outer peripheral surface of the displacer and an inner peripheral surface of the cylinder, and when the displacer is set to an orbiting position, a plurality of spaces are formed by the outer peripheral surface of the displacer and the inner peripheral surface of the cylinder, wherein there is provided an oil retaining mechanism for retaining oil between the displacer and each of the end plates.

The above object has been achieved also by a displacement fluid machine comprising a cylinder provided between end plates, the cylinder having an inner peripheral surface formed by curves continuous with one another in its plan view, and a displacer having an outer peripheral surface disposed in opposed relation to the inner peripheral surface of the cylinder, in which, when the displacer makes an orbital motion, a plurality of spaces are formed by the inner peripheral surface, the outer peripheral surface and the end plates, wherein there is provided an oil retaining mechanism for retaining oil between the displacer and each of the end plates.

The above object has been achieved also by a displacement fluid machine comprising a displacer and a cylinder which are provided between end plates, in which, when a center of the displacer and a center of the cylinder are aligned with each other, one space is formed by an outer peripheral surface of the displacer and an inner peripheral surface of the cylinder, and when the displacer is set to an orbiting position, a plurality of spaces are formed by the outer peripheral surface of the displacer and the inner peripheral surface of the cylinder, wherein there is provided an oil retaining mechanism for retaining oil between the displacer and each of the end plates.

The above object has been achieved also by a displacement fluid machine comprising a displacer and a cylinder which are provided between end plates, in which, when a center of the displacer and a center of the cylinder are aligned with each other, one space is formed by an outer peripheral surface of the displacer and an inner peripheral surface of the cylinder, and when the displacer is set to an orbiting position, a plurality of spaces are formed by the outer peripheral surface of the displacer and the inner peripheral surface of the cylinder, wherein there is provided an oil supply mechanism for supplying oil to end surfaces of the displacer.

In an orbiting fluid machine in which a displacer has a relatively flattened shape, it is thought that the lowering of the performance described above is attributable to a poor seal in a gap (gap in the axial direction) between the displacer and each end plate. According to the present invention described above, there can be provided the orbiting fluid machine in which an internal leakage of the working fluid through the axial gap between the displacer and each end plate, which is caused by the pressure difference between the compression operation chambers within the cylinder and a suction chamber, is greatly reduced, thereby enhancing the performance. And besides, an internal leakage of the working fluid through gaps in sliding portions of the displacer and the cylinder, which jointly form the operation chambers, can also be suppressed, and therefore a fluid loss and a mechanical friction loss is reduced, and there can be provided the displacement fluid machine of a high efficiency.

DESCRIPTION OF THE PREFERRED EMBODIMENTS

A preferred embodiment of the present invention will now be described in detail with reference to the drawings. FIG.

Figure 1:
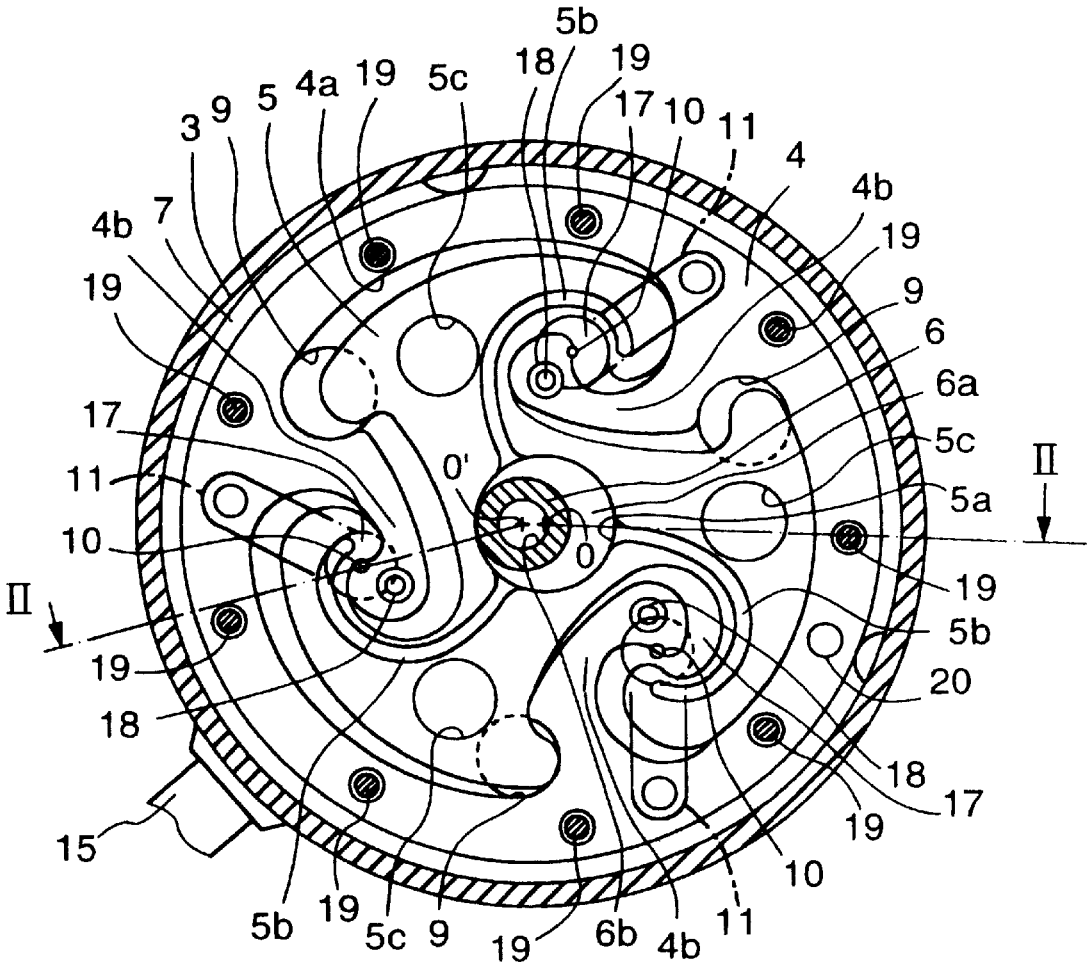
FIG. 1 is a cross-sectional view, taken along the line I—I of FIG. 2, of a hermetic-type compressor to which applys an orbiting fluid machine in accordance with one preferred embodiment of the invention.
Figure 2:
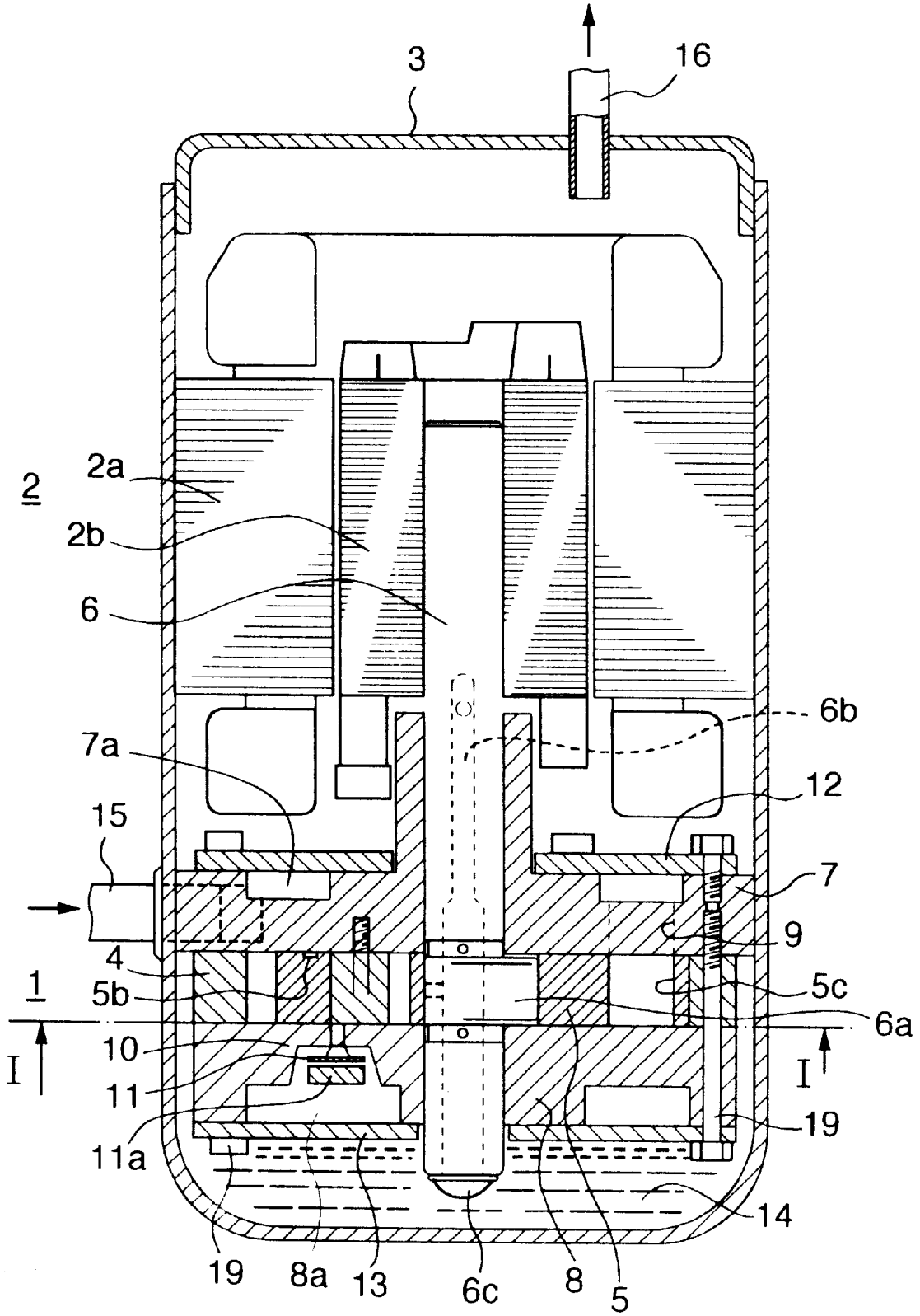
FIG. 2 is a longitudinal sectional view taken along the line II—II of FIG. 1.
Figure 3A:
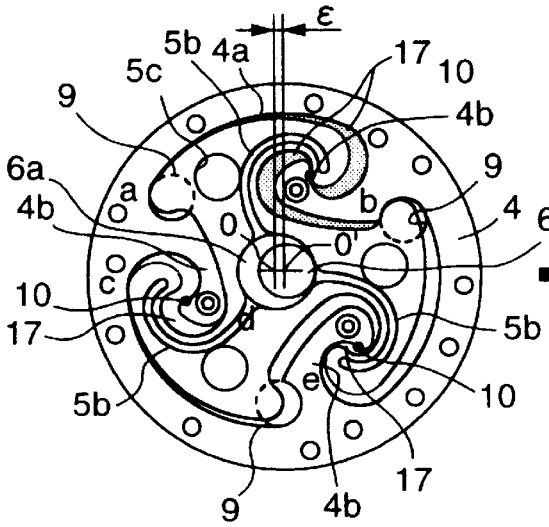
FIGS. 3A to 3D are views showing the principle of the operation of the orbiting fluid machine in accordance with the invention.
Figure 3B:
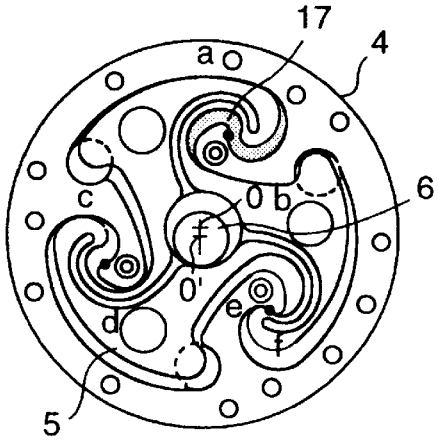
Figure 3C:
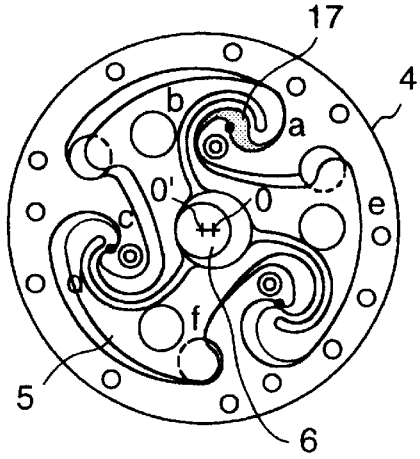
Figure 3D:
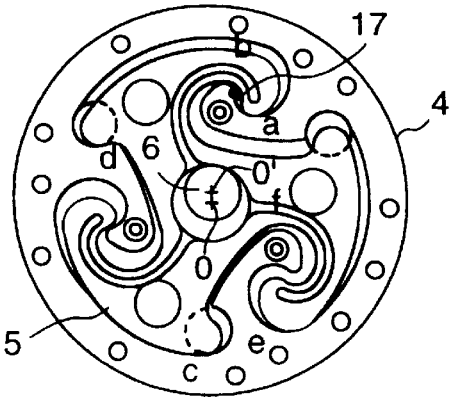
Figure 4:
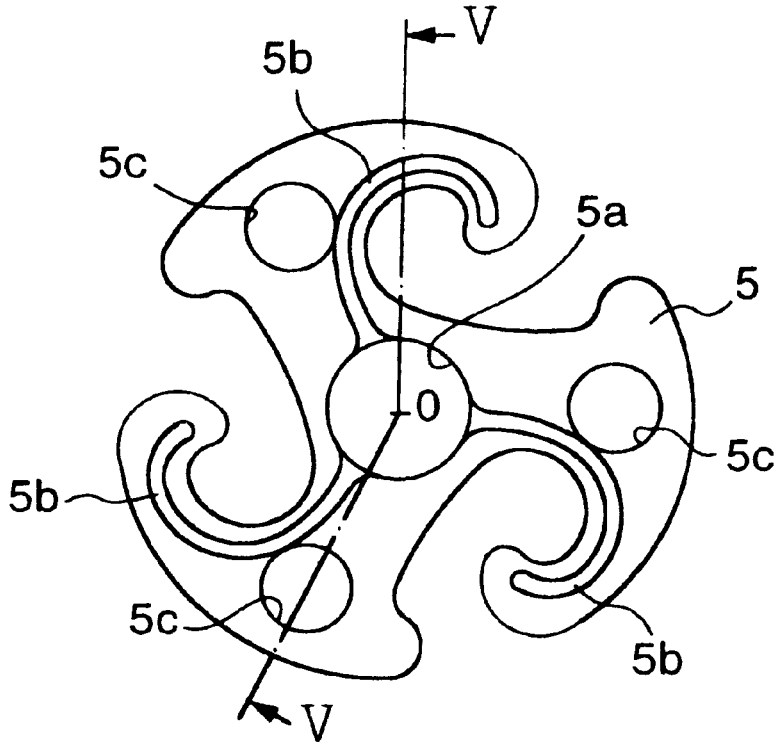
FIG. 4 is a plan view of a displacer of the orbiting fluid machine in accordance with the invention.
Figure 5:
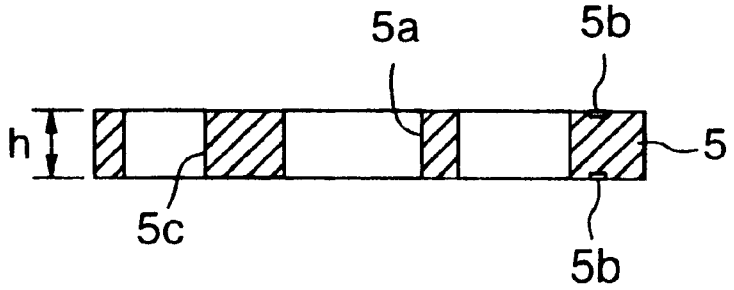
FIG. 5 is a cross-sectional view taken along the line V—V of FIG. 4.
Figure 6:
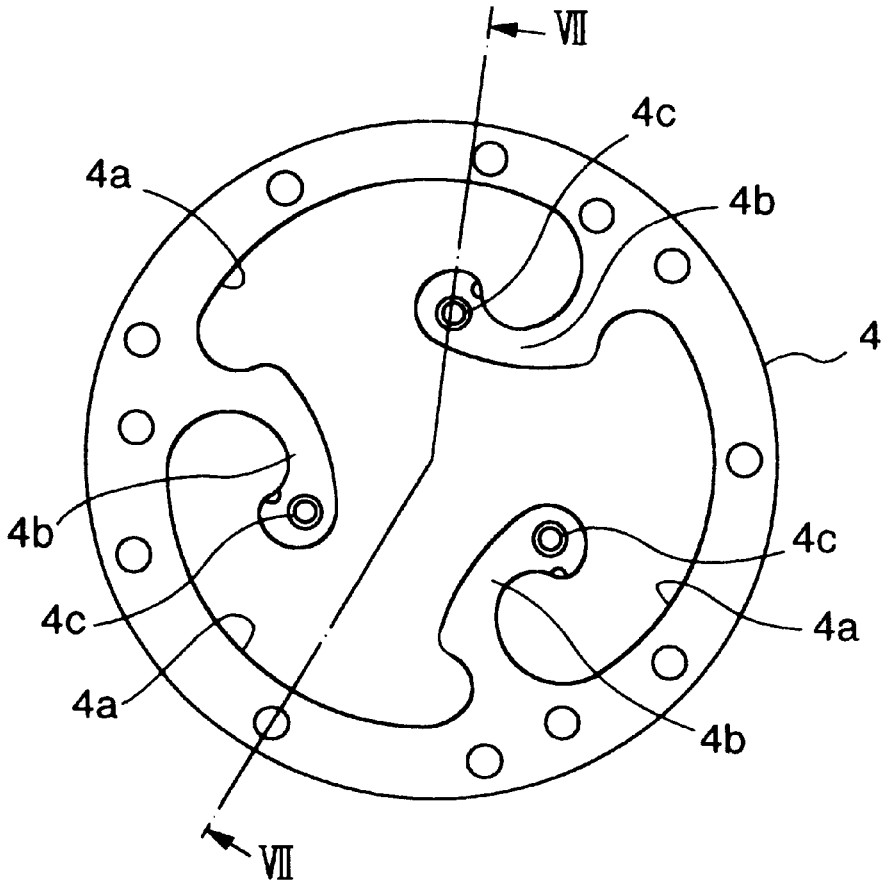
FIG. 6 is a plan view of a casing of the orbiting fluid machine in accordance with the invention.
Figure 7:
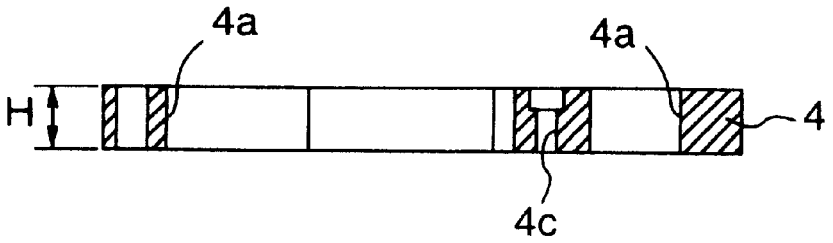
FIG. 7 is a cross-sectional view taken along the line VII—VII of FIG. 6.
Figure 8:
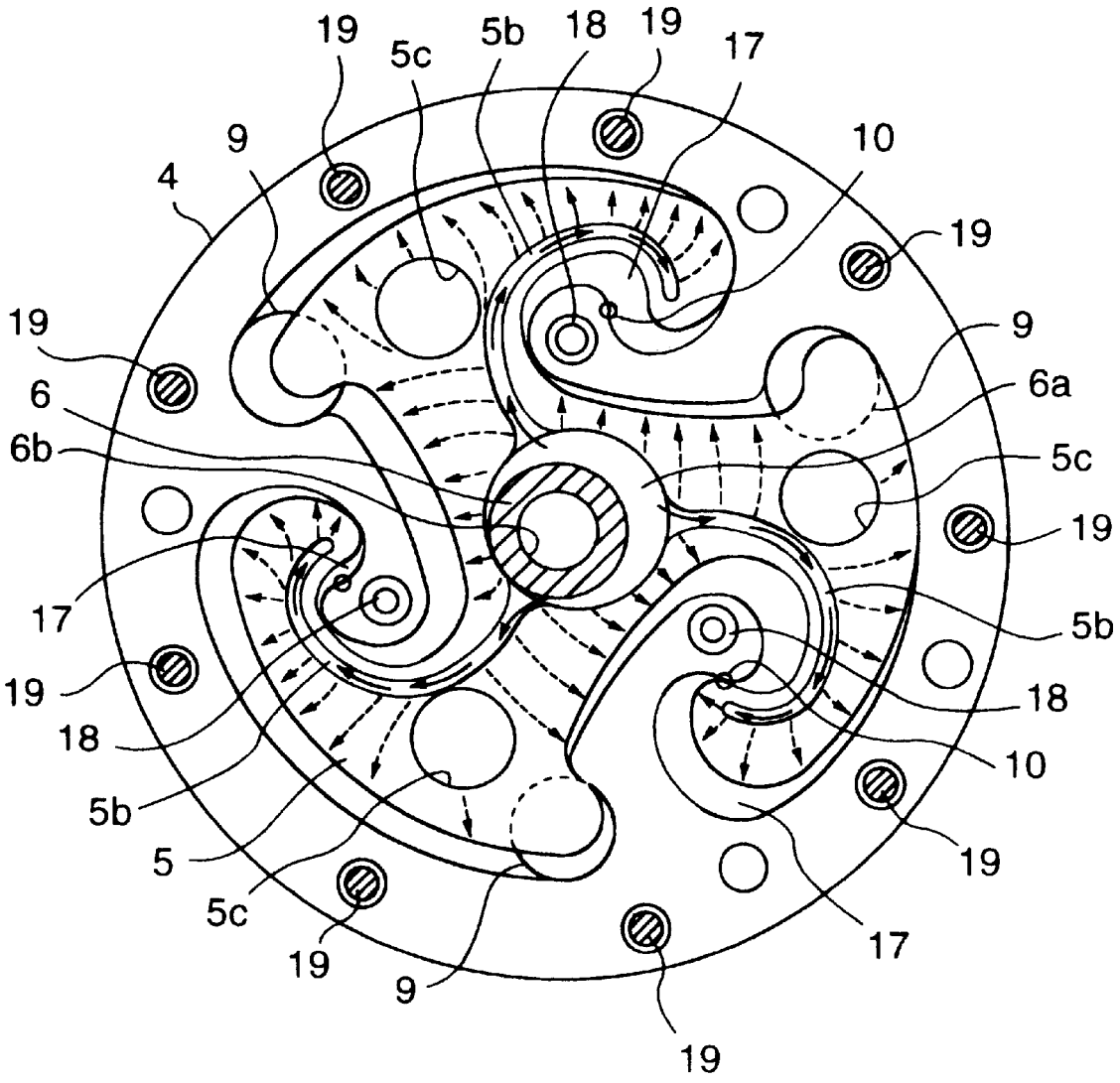
FIG. 8 is a view explaining the formation of an oil film at an end surface of the displacer in accordance with the invention.

1 is a cross-sectional view of a hermetic type compressor using an orbiting fluid machine according to a preferred embodiment of the invention, FIG. 2 is a cross-sectional view taken along the line II—II of FIG. 1, FIG. 3 is a plan view showing the principle of the operation of the compressor using an orbiting fluid machine in accordance with the invention, FIG. 4 is a plan view of a displacer in accordance with the invention, FIG. 5 is a cross-sectional view taken along the line V—V of FIG. 4, FIG. 6 is a plan view of a casing for engagement with the displacer, FIG. 7 is a cross-sectional view taken along the line VII—VII of FIG. 6, and FIG. 8 is a view explaining the formation of an oil film at an end surface of the displacer.

In FIG. 2, reference numeral 1 denotes an orbiting compression element of the invention, reference numeral 2 an electrically-operating element for driving the orbiting compression element 1, and reference numeral 3 a sealed vessel or container containing the orbiting compression element 1 and the electrically-operating element 2. In FIG. 1, the orbiting compression element 1 includes the casing (referred to also as "cylinder") 4 having a plurality of projecting portions 4*b* which extend inwardly from an inner peripheral surface 4*a* of the casing 4, and have fixing holes 4*c* (see FIG. 6) formed respectively therethrough, the displacer 5 (referred to also as "orbiting piston") which is provided inside the casing 4, and is engaged with the inner peripheral surface 4*a* and the projecting portions 4*b*, a drive shaft 6 having a crank portion 6*a* which is fitted in a bearing 5*a*, formed at a central portion of the displacer 5, for rotating the displacer 5, main and auxiliary bearings 7 and 8 which serve as bearings to bear the drive shaft 6, and also serve respectively as end plates closing opposite open ends (spaced from each other in an axial direction) of the casing 4, suction holes 9 formed in the end plate of the main bearing 7, discharge ports 10 formed in the auxiliary bearing 8, reed-type discharge valves 11 for opening and closing the respective discharge ports 10, and retainers (valve stoppers) 11*a*.

In FIG. 1, oil grooves 5*b* are formed in each of the opposite end surfaces of the displacer 5, and are defined respectively by a plurality of shallow grooves (having a depth of about 0.5 mm) each extending from the central bearing 5*a* of the displacer 5 to an outer peripheral end portion thereof in a curved manner. Through holes 5*c* are formed through the displacer 5, and extend between the opposite end surfaces thereof. In FIG. 2, a suction cover 12 is secured to the main bearing 7, and cooperates therewith to form a suction chamber 7*a* in the main bearing 7, and this suction chamber 7*a* is isolated from the pressure (discharge pressure) within the sealed vessel 3. A discharge cover 13 is secured to the auxiliary bearing 8, and cooperates therewith to form a discharge chamber 8*a* in the auxiliary bearing 8.

The electrically-operating element 2 comprises a stator 2*a* and a rotor 2*b*, and the rotor 2*b* is fixedly mounted on one end portion of the drive shaft 6 by shrinkage fit or the like. Lubricating oil 14 is stored in a bottom portion of the sealed vessel 3, and a lower end portion of the drive shaft 6 is immersed in this lubricating oil. Reference numeral 6*b* denotes an oil feed hole which supplies the lubricating oil 14 to various sliding portions in the bearings and so on by a centrifugal pumping action caused by the rotation of the drive shaft 6. An oil feed piece 6*c* is mounted on the lower end of the drive shaft 6. Reference numeral 15 denotes a suction (intake) pipe, reference numeral 16 a discharge pipe, and reference numerals 17 (FIG. 1) operation chambers formed by engagement of the displacer 5 with the inner peripheral surface 4*a* and projecting portions 4*b* of the casing 4. Reference numeral 19 denotes an assembling bolt for the compression element, reference numeral 18 a fixing bolt for preventing the deformation of the projecting portion 4*b* of the casing 4 due to a pressure, and reference numeral 20 a discharge gas passage.

The flow of working gas (working fluid) will be described with reference to FIG. 2. As indicated by arrows in this Figure, the working gas, fed into the sealed vessel 3 through the suction pipe 15, enters the orbiting compression element 1 via the suction ports 9 formed in the main bearing 7, and the rotation of the drive shaft 6 causes the displacer 5 to make an orbital motion, so that the volume in the operation chamber is reduced, thereby effecting a compression operation (as will be more fully described later). The compressed working gas flows through the discharge port 10 which is formed in the end plate of the auxiliary bearing 8, and opens the discharge valve 11, and flows into the discharge chamber 8*a*, and further flows through a discharge gas passage (not shown) which is formed in outer peripheral portions of the auxiliary bearing 8, casing 4 and the main bearing 7, and enters the space in the sealed vessel 3, and is discharged from the discharge pipe 16 via the electrically-operating element 2.

Next, the principle of the operation of the orbiting compression element 1 will be described with reference to FIGS. 3A to 3D. Reference character ○ denotes the center of the displacer 5, and reference character ○' denotes the center of the casing 4 (and the center of the drive shaft 6). Reference characters a, b, c, d, e and f denote points of contact or engagement (i.e., seal points) of the displacer 5 with the inner peripheral surface 4*a* and projecting portions 4*b* of the casing 4. The configuration or contour of the inner peripheral surface of the casing 4 is formed by combining three identical curves together in smoothly-continuous relation to one another. Referring to one of these curves, those curves, respectively forming the inner peripheral surface 4*a* and the projecting portion (vane) 4*b*, can be regarded as one volute curve having a thickness, and its inner wall curve is a volute curve having a substantial winding angle of about 360°, and its outer curve is also a volute curve having a substantial winding angle of about 360°. Namely, in FIG. 3A, this means that two different volute curves of 360° are present between the contact points a and b. Volute portions each composed of these two curves are circumferentially arranged at substantially equal intervals around the center ○', and the outer wall curve and the inner wall curve (for convenience of explanation, the terms "outer wall" and "inner wall" are used, but here, the term "inner peripheral surface of the casing" should be construed as including the two) of any two adjacent volute portions are interconnected by a smooth curve, such as an arc, thereby forming the inner peripheral configuration or contour.

The configuration or contour of the outer peripheral surface of the displacer 5 is also formed according to the same principle as described for the casing 4. Namely, when the center of the displacer 5 and the center of the casing 4 are aligned with each other, the outer peripheral surface of the displacer 5 is spaced from the inner peripheral surface of the casing 4 by a distance equal to a radius $\epsilon$ of revolution (orbital motion). Namely, the two are similar in shape to each other.

Referring to the compression operation, when the drive shaft 6 is rotated in a clockwise direction, the displacer 5 revolves (that is, makes an orbital motion) with the orbital radius $\epsilon$ (=○○') around the center ○' of the casing 4, so that a plurality of (always three in this embodiment) operation chambers 17 are formed around the center ○ of the displacer 5. Referring to one operation chamber 17

(indicated by a shadow in the illustration) formed between the contact point a and the contact point b (This chamber is divided into two chambers at the time of the end of the suction stroke, but these two chambers are combined into one chamber immediately when the compression stroke begins.), FIG. 3A shows a condition in which the drawing of the working fluid into this operation chamber from the suction port 9 is finished, and a condition, obtained by rotating the drive shaft 6 clockwise through 90 degrees from this condition, is shown in FIG. 3B, and a condition, obtained by rotating the drive shaft 6 clockwise through 90 degrees from the condition of FIG. 3B, is shown in FIG. 3C, and a condition, obtained by rotating the drive shaft 6 clockwise through 90 degrees from the condition of FIG. 3C, is shown in FIG. 3D, and when the drive shaft 6 is further rotated clockwise through 90 degrees, the compression element is returned to the initial condition of FIG. 3A. Thus, as the rotation of the drive shaft 6 proceeds, the volume of the operation chamber 17 is reduced, and the compression of the working fluid is effected since the discharge port 10 is closed by the discharge valve 11. Then, when the pressure within the operation chamber 17 becomes higher than the outside discharge pressure, the discharge valve 11 is automatically opened by this pressure difference, and the compressed working gas is discharged through the discharge port 10. The angle of rotation of the shaft during the stroke from the end of the suction (the start of the compression) to the end of the discharge is 360° (which is larger than 180°), and during the time when the compression stroke and the discharge stroke are effected, the next suction stroke is prepared, and when the suction is finished, the next compression is initiated. In this embodiment, the operation chamber, undergoing the suction stroke, is adjacent to the operation chamber, undergoing the compression (discharge) stroke. The operation chambers, which thus continuously effect the compression operation, are arranged and spaced at substantially equal intervals around the drive shaft bearing 5*a* formed at the central portion of the displacer 5, and the operation chambers effect the compression in a phase-shifting manner, and therefore a torque variation, as well as a pressure pulsation of the discharge gas, is reduced to a very small value, so that vibrations and noises, resulting therefrom, can be reduced.

That operation chamber, disposed counterclockwise adjacent to the operation chamber 17 in FIG. 3C, is undergoing the suction stroke, but when the condition of FIG. 3D is obtained, this single operation chamber is divided into two portions, and the working fluids, filled respectively in these two portions, are discharged therefrom respectively through the different discharge ports, which is one feature of the displacement fluid machine of this embodiment. The working fluid of an amount equal to this division amount is supplied from that operation chamber disposed clockwise adjacent to the above operation chamber.

As described above, the operation chambers, which continuously effect the compression operation, are arranged and spaced at substantially equal intervals around the drive shaft bearing 5*a* formed at the central portion of the displacer 5, and the compression is effected in a phaseshifting manner. Namely, referring to one space, although the stroke from the suction to the discharge is 360° in terms of the angle of rotation of the shaft, the three operation chambers discharge the working fluid 120 degrees out of phase with each other in this embodiment, and therefore the working fluid is discharged three times during the rotation of the shaft through 360° in the compressor. The feature that the discharge pulsation of the working fluid can thus be reduced is not achieved in a reciprocating-type, a rotary-type and a scroll fluid machine. If the space (formed between the contact points a and b), in which the compression is just finished, is regarded as one space, the space, undergoing the suction stroke, and the space, undergoing the compression stroke, are alternately disposed in any condition of the compressor, and therefore immediately after the compression stroke is finished, the following compression stroke is effected, so that the fluid can be compressed in a smoothly continuous manner.

In the displacement fluid machine disclosed in the above documents 1 and 2, there exists a time period during which the suction port communicates with the discharge port via one space formed between the displacer and the casing. This communication period does not substantially contribute to the suction and compression (discharge), and is useless. In the displacement fluid machine of this embodiment, the communication period as seen in the above documents 1 and 2 does not exist, and all of the spaces serve as the operation chambers, and therefore the displacement fluid machine can achieve a high efficiency.

Next, a method of effectively sealing a gap (gap in the axial direction) between the displacer and each of the end plates (which method is one feature of the invention) will be described. FIG. 4 is a plan view of the displacer 5 of the invention, FIG. 5 is a cross-sectional view taken along the line V—V of FIG. 4, FIG. 6 is a plan view of the casing 4 for engagement with the displacer, FIG. 7 is a cross-sectional view taken along the line VII—VII of FIG. 6, and FIG. 8 is a view explaining the formation of an oil film at an end surface of the displacer.

In the drawings, a height h of the displacer 5 is slightly (about 10 $\mu$m) smaller than a height H of the casing 4. These dimensions can be relatively easily made highly precise by ordinary surface grinding, and the axial gap between the displacer 5 and the end plate can be controlled to a very small value (of about 5 $\mu$m). The three oil grooves 5*b* are formed in each of the opposite end surfaces of the displacer 5, and are defined respectively by shallow grooves (having a depth of about 0.5 mm) each extending from the central bearing 5*a* of the displacer 5 to the outer peripheral end portion thereof in a curved manner. As will be appreciated from the principle of the compression operation in FIG. 3, these oil grooves 5*b* are arranged to generally surround the operation chambers 17 under high pressure. The sealing of the axial gap is effected in the following manner.

The lubricating oil 14, stored in the bottom portion of the sealed vessel 3, is drawn up by the centrifugal pumping action caused by the rotation of the drive shaft 6, and is supplied via the oil feed hole 6*b* to the various sliding portions in the bearings and so on, and that portion of the lubricating oil 14, supplied to the bearing 5*a* at the central portion of the displacer 5, reaches the opposite ends of this bearing 5*a*, and then is supplied to the outer peripheral end portion of the displacer 5 through the oil grooves 5*b* as indicated by solid-line arrows in FIG. 8. On the way to the outer peripheral end portion of the displacer 5, the lubricating oil 14 under high pressure (discharge pressure) moves as indicated by broken-line arrows by the pressure difference from the low-pressure portion in the casing 4, so that an oil film is formed uniformly on each of the opposite end surfaces of the displacer 5 (a dot-and-dash line indicates a path along which the lubricating oil 14, supplied to the bearing 5*a*, moves directly to the low-pressure portion in the casing 4.). Therefore, the sealing effect by the oil film effectively, and an internal leakage of the working gas through the gap between the displacer and each end plate, which is caused by the pressure difference between the (compression) operation chambers in the casing 4 and the suction chamber, is greatly reduced, and therefore the orbiting fluid machine of a high performance can be provided. Further, the oil, having entered the operation chambers and the suction chamber, effectively seals gaps (gaps in the radial direction) at the points a, b, c, d, e and f (FIG. 3) of contact (engagement) of the displacer 5 with the casing 4, thus contributing the reduction of an internal leakage of the working gas. The number and configuration of the oil grooves 5*b* are not limited to those in the above embodiment, but can be suitably determined in accordance with the operating condition of the compressor, the amount of the oil required for the sealing operation, the amount of the oil required for lubricating the sliding portions, and so on, and for example, the optimum lubricating construction from the viewpoints of the performance and reliability can be easily achieved, and therefore the degree of freedom of the mechanical design can be greatly increased.

Figure 9:
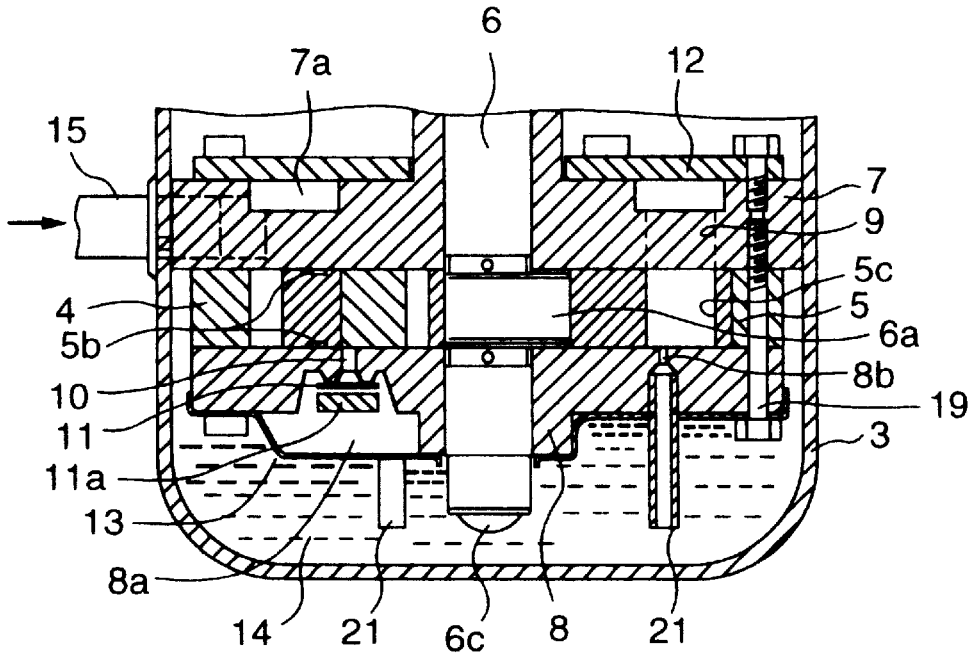
FIG. 9 is a longitudinal sectional view of an important portion of a compressor in accordance with another embodiment of the invention.
Figure 10:
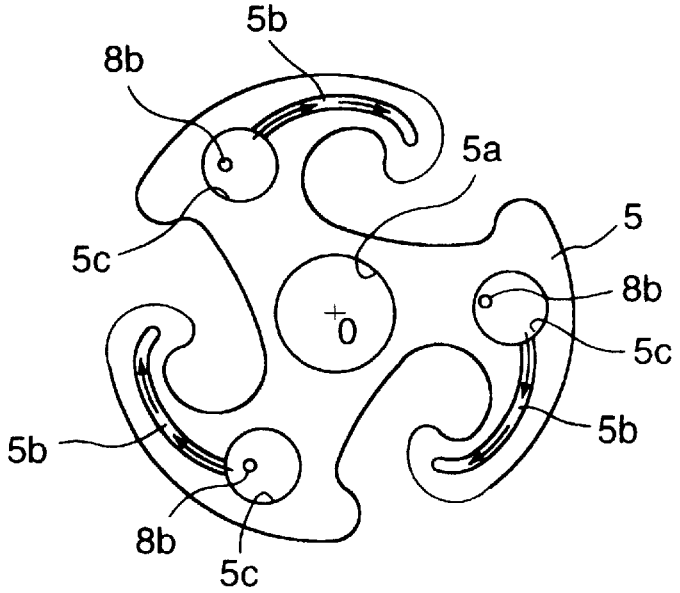
FIG. 10 is a plan view of a displacer of the compressor of FIG. 9.

FIG. 9 is a longitudinal sectional view of an important portion of a hermetic-type compressor according to another embodiment of the invention, and FIG. 10 is a plan view of a displacer in FIG. 9. Here, those parts identical to those of FIGS. 1 and 2 are designated respectively by identical reference numerals, and perform identical operations. In the drawings, oil feed pipes 21 are fixedly mounted on an end plate of an auxiliary bearing 8, and one ends of these oil feed pipes 21 are open into lubricating oil 14 stored in a bottom portion of a sealed vessel 3 while the other ends thereof are connected respectively to oil feed holes 8*b* formed in the end plate of the auxiliary bearing 8, and communicate respectively with through holes 5*c* formed through the displacer 5. Three oil grooves 5*b* are formed in each of opposite end surfaces of the displacer 5, and extend respectively from the through holes 5*c* to an outer peripheral end portion thereof in a curved manner. With this construction, by the pressure difference, the lubricating oil is supplied into the through holes 5*c* and the oil grooves 5*b* via the oil feed pipes 21, so that an oil film is formed uniformly on each of the opposite end surfaces of the displacer 5 as in the preceding embodiment, and therefore an internal leakage of working gas through an axial gap is greatly reduced. In this embodiment, paths of supply of the oil to the end surfaces of the displacer 5 are provided independently of an oil supply pumping action by a drive shaft 6, and therefore the amount of supply of the oil to the end surfaces of the displacer can be easily increased without affecting the supply of the oil to the sliding portions in the bearings and so on, and therefore the reliability of the compressor can be enhanced.

Figure 11:
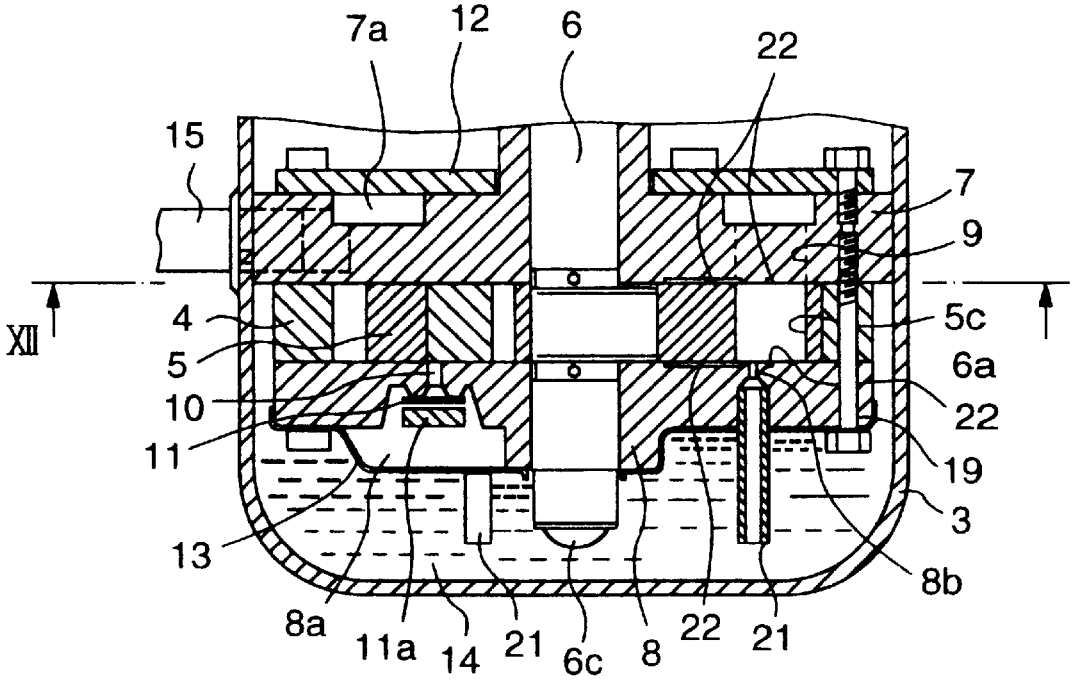
FIG. 11 is a longitudinal sectional view of an important portion of a compressor in accordance with a further embodiment of the invention.
Figure 12:
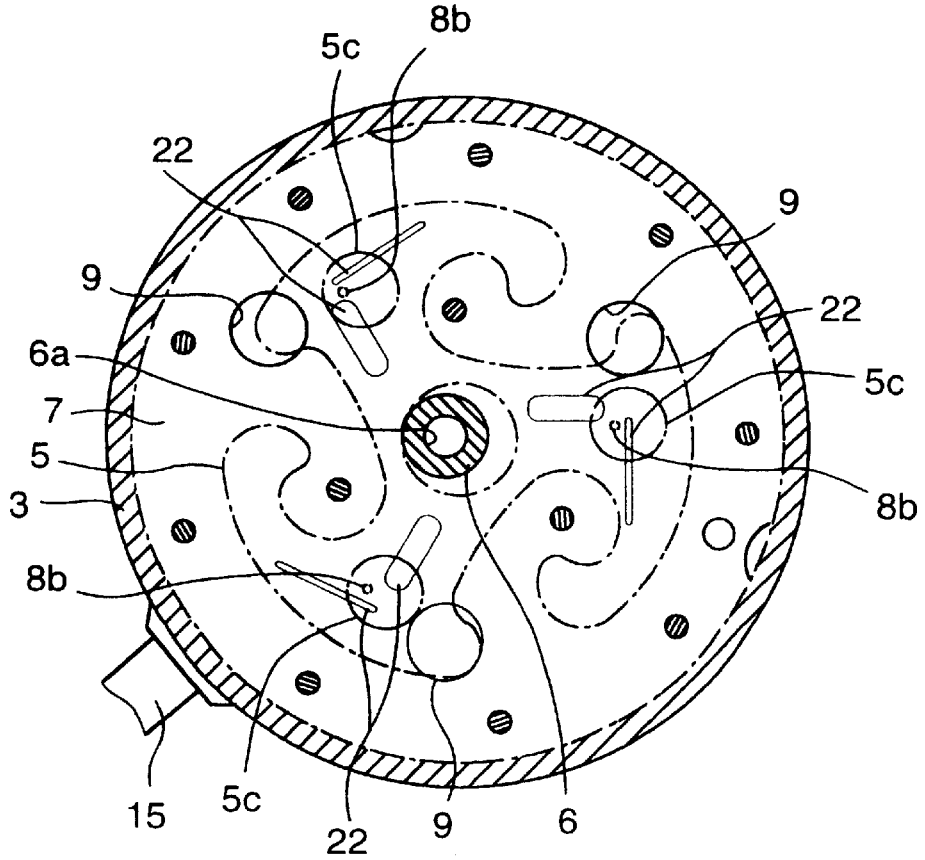
FIG. 12 is a cross-sectional view taken along the line XII—XII of FIG. 11.

FIG. 11 is a longitudinal sectional view of an important portion of a sealed-type compressor according to a further embodiment of the invention, and FIG. 12 is a cross-sectional view taken along the line XII—XII of FIG. 11. In the drawings, oil grooves 22 are formed in a surface of an end plate of a main bearing 7 held in sliding contact with a displacer 5, and similar oil grooves 22 are formed in a surface of an end plate of an auxiliary bearing 8 held in sliding contact with the displacer 5. One of opposite ends of each of these oil grooves 22 is always in communication with any of through holes 5*c*, formed through the displacer 5, even when the displacer 5 is at any rotational angle position, and as can been appreciated from FIG. 12, the oil grooves 22 are always disposed within the outer periphery of the displacer 5 indicated by a dot-and-dash line. With this construction, lubricating oil 14 is supplied into the oil grooves 22 via oil feed pipes 21 and the through holes 5*c*, so that an oil film is formed uniformly on each of the opposite end surfaces of the displacer 5 through the oil grooves 22 as in the embodiment of FIG. 9, and therefore similar effects can be achieved. Thus, the oil grooves can be formed either of the moving member (displacer) and the fixed member (end plate of the bearing), and therefore the degree of design can be increased.

Figure 13:
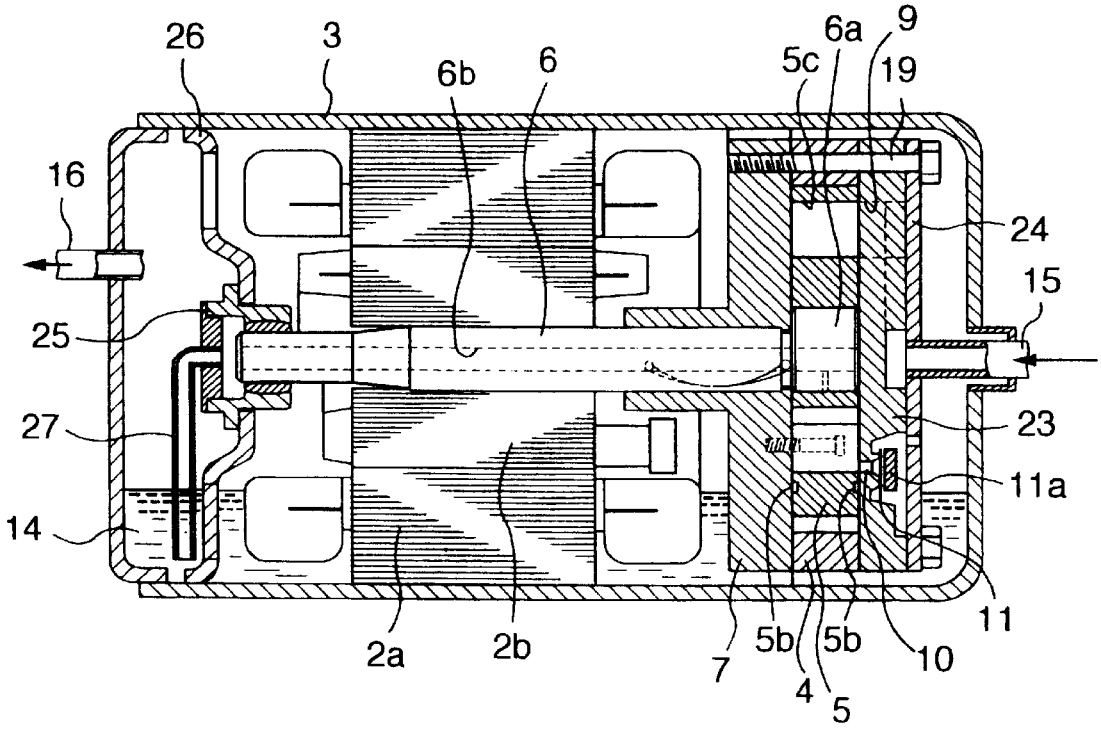
FIG. 13 is a longitudinal sectional view of a compressor in accordance with a further embodiment of the invention.

FIG. 13 is a longitudinal sectional view of a hermetic-type compressor according to a further embodiment of the invention. In this embodiment, the present invention is applied to the horizontal-type compressor. In FIG. 13, reference numeral 23 denotes a front head closing an open end of a casing 4, and suction ports 9 and discharge ports 10 are formed in the front head 23, thereby simplifying the construction. A head cover 24 covers an end surface of the front head 23. An auxiliary bearing 25 bears one end of a drive shaft 6 disposed adjacent to an electrically-operating element 2, and is fixed to a sealed vessel 3 through a frame 26. An oil feed pipe 27 is connected to the auxiliary bearing 25 in a manner to sealingly close an end of the auxiliary bearing 25, and one end of the oil feed pipe 27 is open into lubricating oil 14.

With this construction, when the drive shaft 6 is rotated, a compression operation is effected by an orbiting compression element 1, and at the same time, by the pressure difference between a discharge pressure and a suction pressure, the lubricating oil 14 in a bottom portion of the sealed vessel 13 is fed into the auxiliary bearing 25 via the oil feed pipe 25, and further passes through an oil feed hole 6*b* formed axially through the drive shaft 6, and is supplied to sliding portions of various bearings. The oil, supplied to a bearing 5*a* at a central portion of a displacer 5, reaches opposite ends of this bearing, and an oil film is formed uniformly on each of opposite end surfaces of the displacer 5 through oil grooves 5*b* as described above in the embodiment of FIGS. 1 to 8. Therefore, an internal leakage of working gas through axial gaps is greatly reduced, and the orbiting fluid machine of a high performance can be provided.

The above embodiments are directed to the hermetic-type compressors in which the pressure within the sealed vessel 3 is high (discharge pressure), and the following advantages are obtained with this high-pressure type compressor:

(1) Since the suction pipe is connected directly to the orbiting compression element, the heating of the suction gas is small, so that the volumetric efficiency can be enhanced.

(2) Since a large proportion of the oil, contained in the discharge gas within the sealed vessel, is separated, the amount of circulation of the oil in a refrigerating cycle is small, so that the efficiency of the refrigerating cycle can be enhanced as well as the efficiency of a heat exchanger.

(3) Since the lubricating oil is under a high pressure, the oil can be easily supplied to the operation chambers through gaps in the sliding portions, so that the lubricating properties of the sliding portions can be enhanced.

Figure 14:
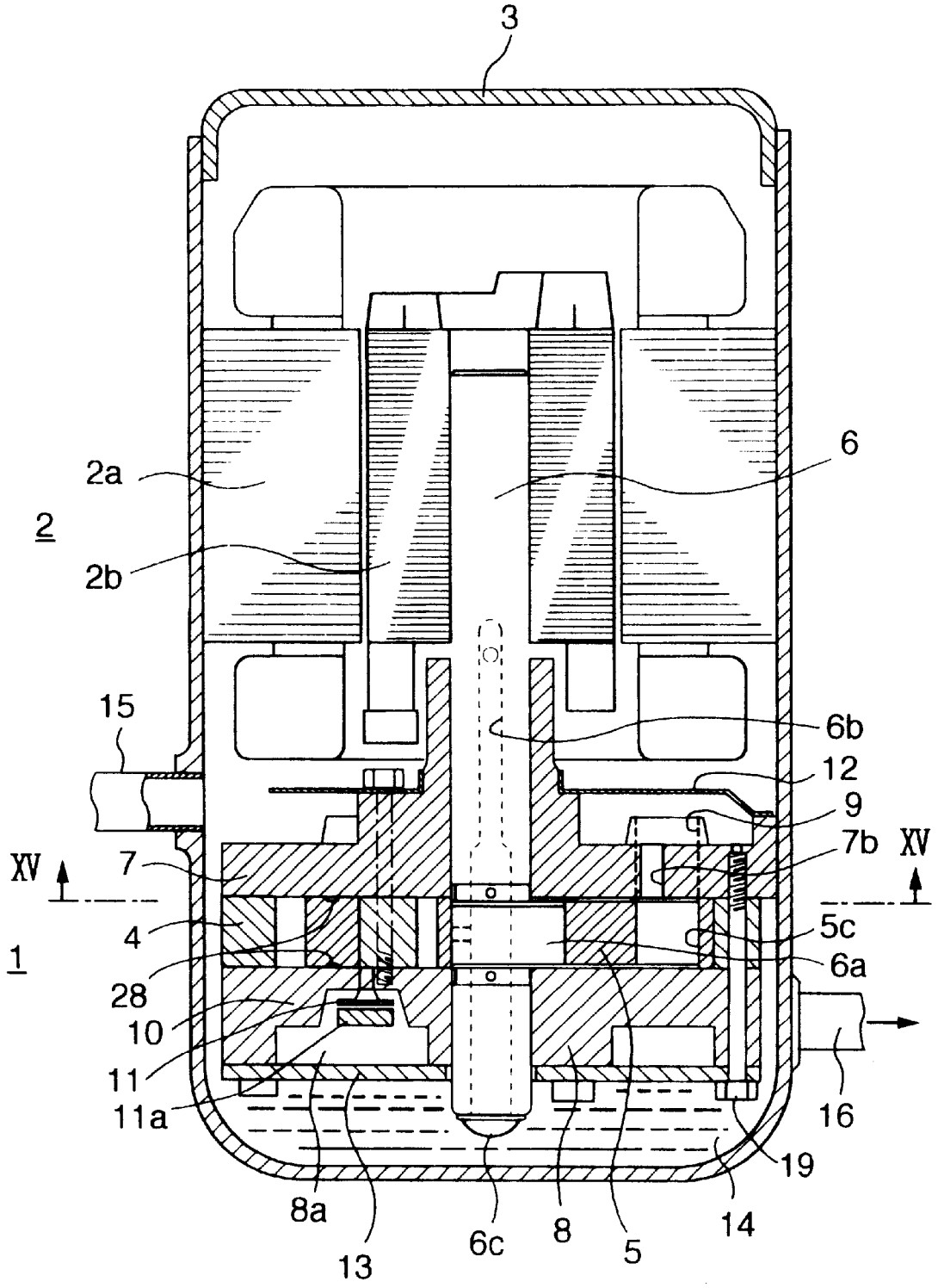
FIG. 14 is a longitudinal sectional view of a low pressure-type compressor in accordance with a further embodiment of the invention.
Figure 15:
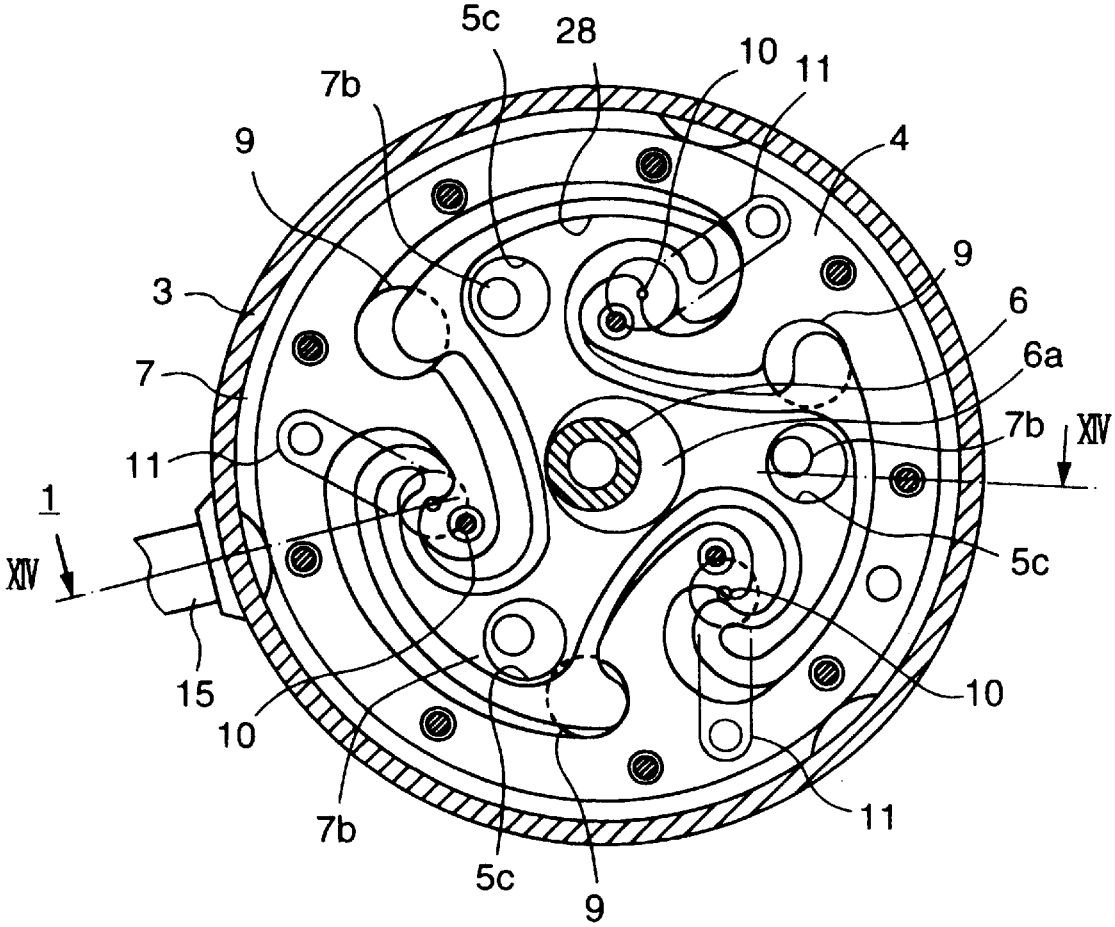
FIG. 15 is a cross-sectional view taken along the line XV—XV of FIG. 14.
Figure 16:
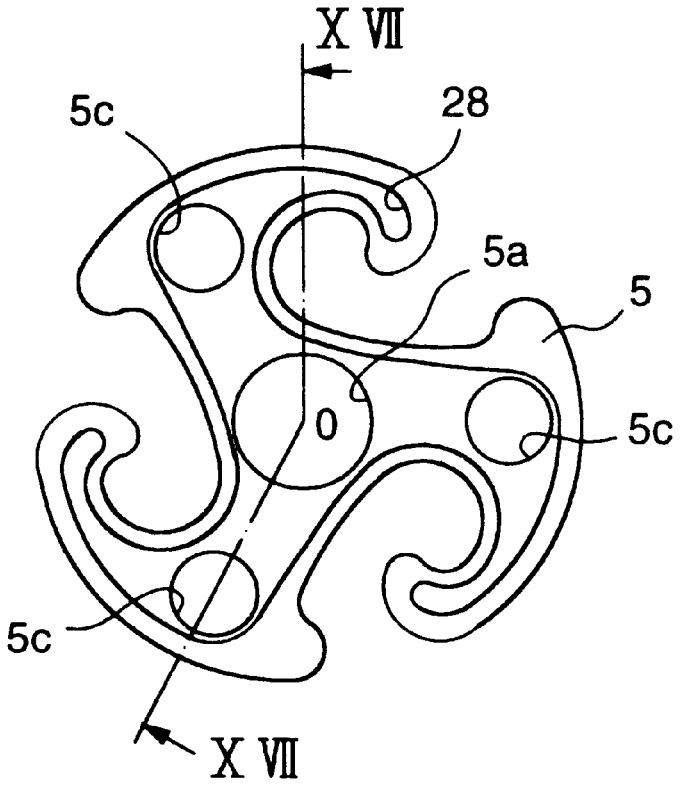
FIG. 16 is a plan view of a displacer of the low pressure-type compressor of FIG. 14.
Figure 17:
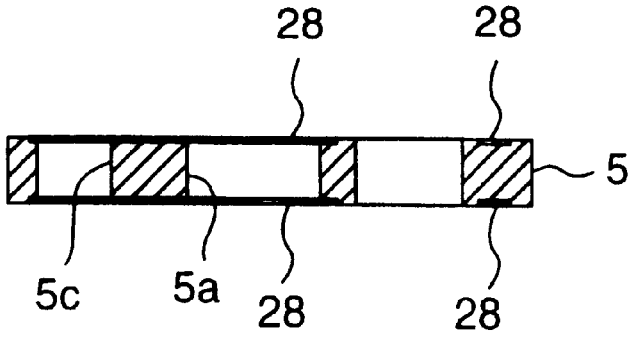
FIG. 17 is a cross-sectional view taken along the line XVII—XVII of FIG. 16.

Next, description will be made of the type of fluid machine in which the pressure within a sealed vessel 3 is low (suction pressure). FIG. 14 is a longitudinal sectional view taken along the line XIV—XIV of FIG. 15, showing a low pressure (suction pressure)-type compressor (orbiting fluid machine) according to a further embodiment of the invention. FIG. 15 is a cross-sectional view taken along the line XV—XV of FIG. 14, FIG. 16 is a plan view of a displacer in accordance with the invention, and FIG. 17 is a cross-sectional view taken along the line XVII—XVII of FIG. 16. In these Figures, those parts identical to those of FIGS. 1 to 8 are designated respectively by identical reference numerals, and perform identical operations. In the low pressure-type compressor, a discharge chamber 8*a*, formed in an auxiliary bearing 8, is separated by a discharge cover 13 from the pressure (suction pressure) within the sealed vessel 3, and working gas in the discharge chamber is discharged directly to the exterior via a discharge pipe 16. Gas relief holes 7*b* are formed through an end plate of a main bearing 7. The principle of the operation of an orbiting compression element 1 is similar to that of the above-mentioned high pressure (discharge pressure)-type compressor. As indicated by arrows in the drawings, the working gas, fed into a suction chamber 7*a* through a suction pipe 15 and the sealed vessel 3, enters the orbiting compression element 1 via suction ports 9 formed in the end plate of the main bearing 7, and the rotation of a drive shaft 6 causes the displacer 5 to make an orbital motion, so that the volume in each operation chamber 17 is reduced, thereby compressing the working gas. The compressed working gas flows through a discharge port 10, formed in the end plate of the auxiliary bearing 8, and opens a discharge valve 11, and flows into the sealed discharge chamber 8*a*, and is discharged to the exterior through the discharge pipe 16.

In the low pressure-type compressor, lubricating oil can not be supplied by the pressure difference as in the high pressure-type compressor, and therefore it is important to provide means by which an oil film can be stably retained in axial gaps disposed respectively at opposite end surfaces of the displacer 5. As shown in FIGS. 16 and 17, in this embodiment, an oil reservoir 28 in the form of a recess with a depth of about 0.5 mm is formed in a large proportion of each of the opposite end surfaces of the displacer 5 (that is, the entire end surface except a sealing margin generally conforming in configuration to the contour of the outer periphery of the displacer 5; this sealing margin has a width smaller than a value twice larger than the orbital radius $\epsilon$.). The oil reservoir 28 in each of the opposite end surfaces of the displacer 5 is continuous with a bearing 5*a* at the central portion of the displacer 5. Therefore, the lubricating oil 14, stored in a bottom portion of the sealed vessel 13, is drawn up by a centrifugal pumping action caused by the rotation of the drive shaft 6, and is supplied via an oil feed hole 6*b* to the various sliding portions in the bearings and so on, and the lubricating oil flows from the bearing 5*a* at the central portion of the displacer 5 into the oil reservoirs 28, and therefore the oil is always retained on the opposite end surfaces of the displacer 5, so that an oil film is formed in the axial gap at each of the opposite end surfaces of the displacer 5 by the orbital motion of the displacer 5. As a result, the sealing effect by the oil is achieved, and an internal leakage of the working gas through the gap (gap in the axial direction) between the displacer and each end plate due to the pressure difference between the (compression) operation chambers in a casing 4 and the suction chamber is reduced, and the orbiting fluid machine of a high performance can be provided. As will be appreciated from FIG. 15, the oil reservoirs 28 is caused to intermittently communicate with each suction port 9, and therefore the lubricating oil is suitably supplied from the suction side into the operation chambers 17, so that a sealing effect for gaps (gaps in the radial direction) at points of contact of the displacer 5 with the casing 4 is also enhanced, thereby reducing an internal leakage of the working gas through these radial gaps. If the working gas leaks into the oil reservoir 28, this leakage working gas is discharged to a low-pressure space through the gas relief holes 7*b* formed through the end plate of the main bearing 7, and therefore the lowering of the lubricating properties of the bearing sliding portions due to the gas, flowed into the oil reservoir 28, is prevented.

Such a low pressure-type compressor has the following advantages:

(1) Since the heating of an electrically-operating element 2 by the compressed working gas of high temperature is small, the temperature of a stator 2*a* and a rotor 2*b* is kept low, so that the efficiency of a motor is enhanced, thereby enhancing the performance.

(2) In the case of the working fluid compatible with the lubricating oil 14, such as freon, the rate of dissolving of the working gas in the lubricating oil 14 is low since the pressure is low, and therefore bubbles are less liable to be formed in the oil in the bearings and so on, so that the reliability can be enhanced.

(3) The pressure resistance of the sealed vessel 3 can be made low, and the sealed vessel 3 can be formed into a thin-wall, lightweight design.

Although the embodiments, in which the internal leakage in the orbiting fluid machine is reduced utilizing the sealing effect of the lubricating oil, have been described above, the internal leakage can be reduced also by providing suitable seal members.

Figure 18:
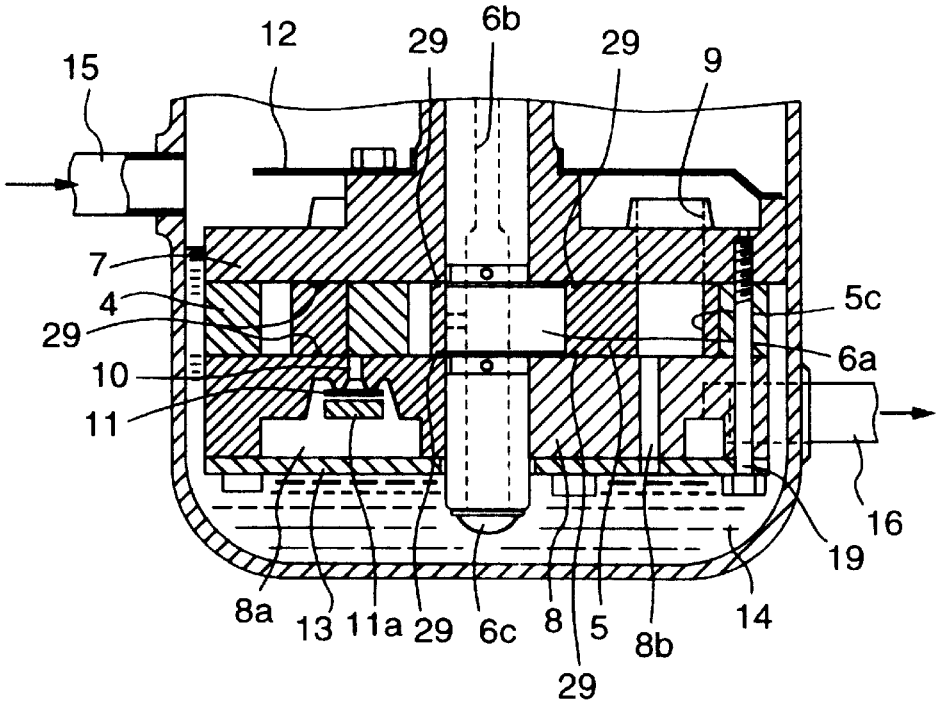
FIG. 18 is a longitudinal sectional view of an important portion of a low pressure-type compressor in accordance with a further embodiment of the invention.
Figure 19:
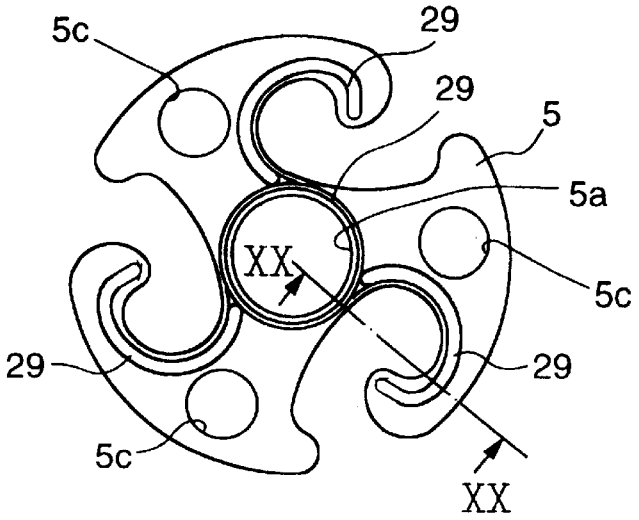
FIG. 19 is a plan view of a displacer of the compressor of FIG. 18.
Figure 20:
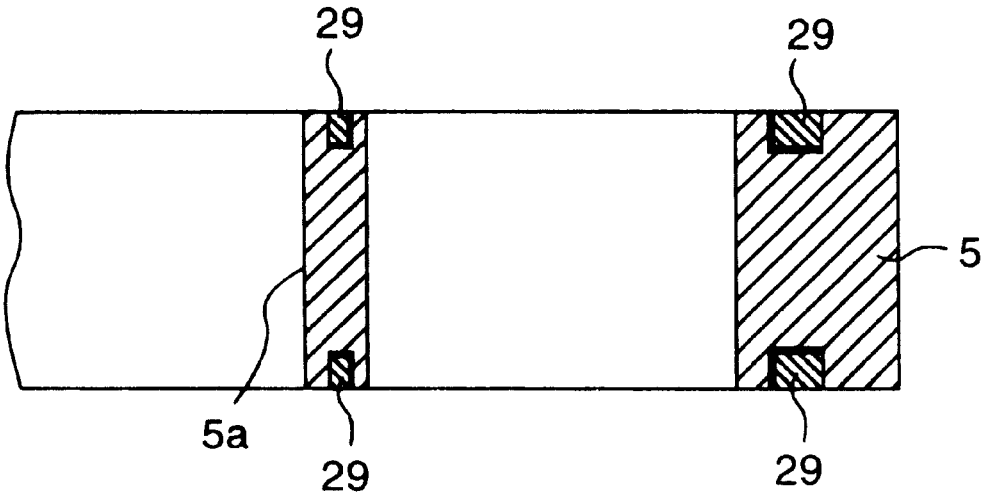
FIG. 20 is a cross-sectional view taken along the line XX—XX of FIG. 19.
Figure 21:
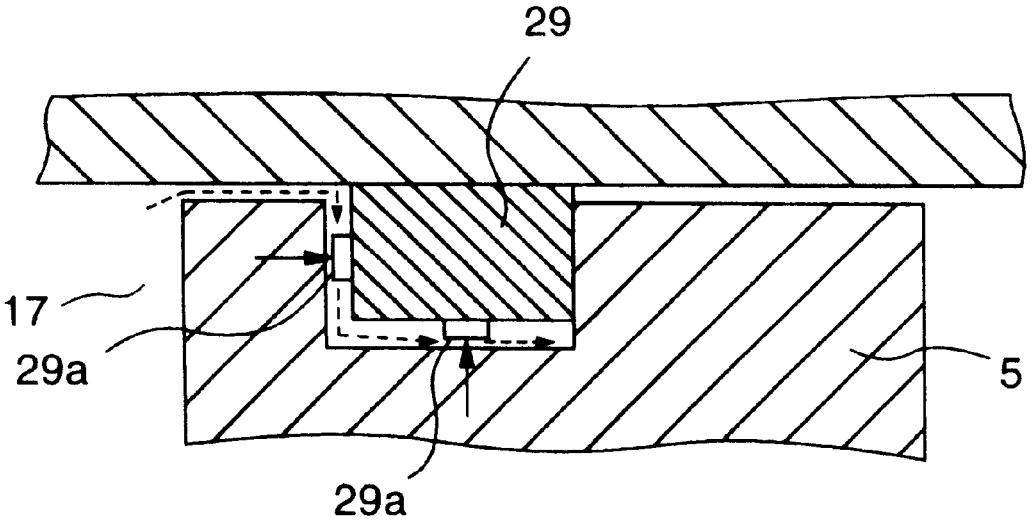
FIG. 21 is a view explaining a sealing operation of a seal member.

FIG. 18 is a vertical cross-sectional view of an important portion of a low pressure (suction pressure)-type compressor (orbiting fluid machine) according to a further embodiment of the invention, FIG. 19 is a plan view of a displacer in accordance with the invention, FIG. 20 is a cross-sectional view taken along the line XX—XX of FIG. 19, and FIG. 21 is view explaining a sealing operation of a seal member. In these Figures, seal members 29 are fitted respectively in grooves formed in each of opposite end surfaces of the displacer 5, and here, two kinds of seal members are used. More specifically, on each end surface of the displacer 5, the annular seal member 29 is provided around a bearing portion 5*a*, and the C-shaped seal members 29 are provided in surrounding relation to high-pressure operation chambers, respectively. These seal members are made, for example, of a synthetic resin material (containing tetrafluoroethylene as a main component) which has a low friction coefficient, and is excellent in self-lubricating properties, oil resistance and thermal resistance. A plurality of projections 29*a* are formed integrally on a side surface of the seal member 29, and also a plurality of projections are formed integrally on a bottom surface of the seal member 29. These projections 29*a* on each of the side surface and the bottom surface form a gap serving as an introduction passage for a high-pressure working fluid. The sealing of an axial gap by this seal member 29 will be described with reference to FIG. 21. When the pressure in the operation chamber 17 inside the C-shaped seal member 29 increases, the pressure acts on those surfaces of the seal member 29, having the projections 29 formed thereon, through the gaps formed by the projections 29*a*, as indicated by broken-line arrows. Because of this gas pressure, forces as indicated by solidline arrows act on the seal member 29, thereby interrupting paths of leakage toward a low-pressure side, and therefore an internal leakage of the working gas through the axial gap is greatly reduced, and the orbiting fluid machine of a high performance can be provided. Also, the flow of the gas into the bearing sliding portion is prevented by the annular seal member 29, and therefore the lubricating performance will not be lowered.

Instead of the projections 29*a*, urging means such as springs may be provided.

Although the orbiting fluid machines, having the three operation chambers arranged in a common plane, have been described above, the present invention is not limited to such a construction, but can be applied to an orbiting fluid machine in which the number of operation chambers is 2 to N (The value of N is 8 to 10 from the viewpoint of practical use.)

When the number of the operation chambers is increased, the following advantages are achieved:

(1) A torque variation is reduced, and vibrations and noises can be reduced.

(2) Assuming that the cylinder (casing) has an outer diameter of a predetermined value, the same suction capacity Vs can be obtained even if the height of the cylinder is reduced, and therefore the size of the compression element can be reduced.

(3) A rotation moment, acting on the orbiting piston (displacer), is reduced, and therefore a mechanical friction loss in the sliding portions of the orbiting piston and the cylinder can be reduced, and the reliability can be enhanced.

(4) A gas pulsation in the suction and discharge pipes is reduced, so that the vibrations and noises can be further reduced. As a result, a fluid machine (a compressor, a pump and so on) with no pulsating flow, which has been required in the medical and industrial fields, can be achieved.

Figure 22:
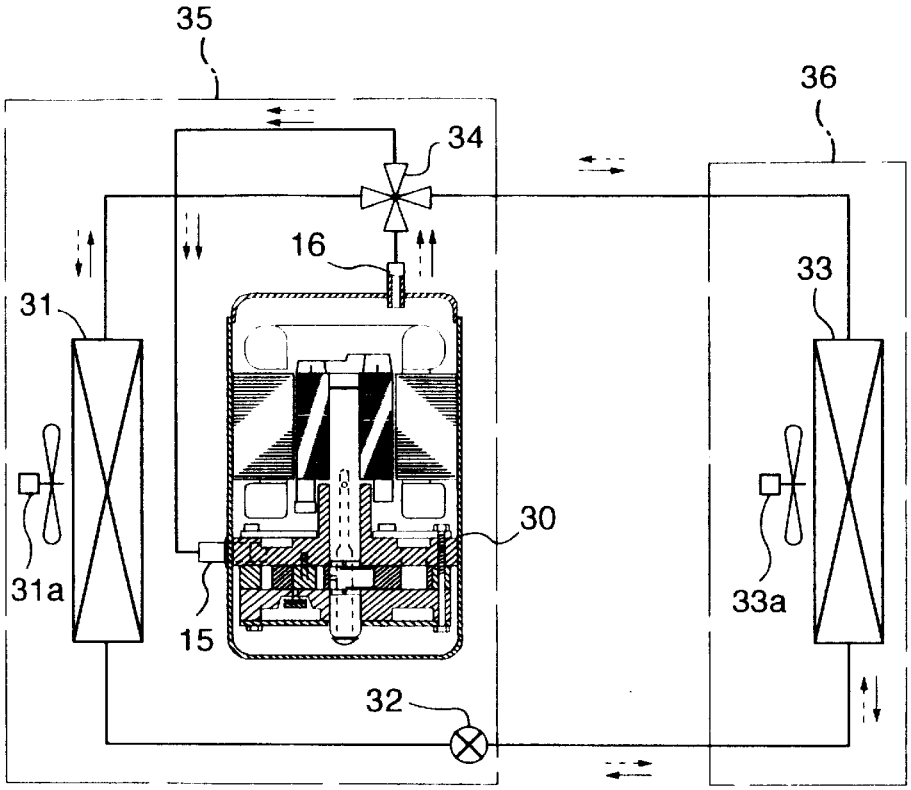
FIG. 22 is an illustration of an air-conditioning system employing an orbiting compressor in accordance with the invention.

A further embodiment of the invention is shown in FIG. 22. FIG. 22 shows an air-conditioning system employing an orbiting compressor of the invention. This cycle is a heat pump cycle capable of effecting the cooling and heating operations, and comprises the orbiting compressor 30 in accordance with the invention described above for FIG. 8, an exterior heat exchanger 31, a fan 31*a* of this heat exchanger, an expansion valve 32, an interior heat exchanger 33, a fan 33*a* of this heat exchanger, and a 4-way valve 34. A dot-and-dash line 35 denotes an exterior unit, and a dot-and-dash line 36 denotes an interior unit. The orbiting compressor 30 operates as described above for FIG. 3 explanatory of the principle of its operation, and when this compressor is activated, a working fluid (e.g. freon HCFC22, R407C or R410A) is compressed between the casing 4 and the displacer 5.

In the case of the cooling operation, as indicated by broken-line arrows, the compressed working gas of high temperature and pressure from the discharge pipe 16 flows into the exterior heat exchanger 31 through the 4-way valve 34, and is caused to radiate heat to be liquefied by an air cooling operation by the fan 31, and then is throttled by the expansion valve 32, and is subjected to adiabatic expansion to have low temperature and pressure, and absorbs the heat in a room by the interior heat exchanger 33 to be gasified, and then is drawn into the orbiting compressor 30 via the suction pipe 15. On the other hand, in the case of the warming operation, as indicated by solid-line arrows, the working gas flows in a direction reverse to that in the cooling operation, and more specifically, the compressed working gas of high temperature and pressure from the discharge pipe 16 flows into the interior heat exchanger 33 through the 4-way valve 34, and is caused to radiate heat into the room to be liquefied by an air cooling operation of the fan 33*a*, and is throttled by the expansion valve 32, and is subjected to adiabatic expansion to have low temperature and pressure, and absorbs heat from the ambient air by the exterior heat exchanger 33 to be gasified, and then is drawn into the orbiting compressor 30 via the suction pipe 15.

Figure 23:
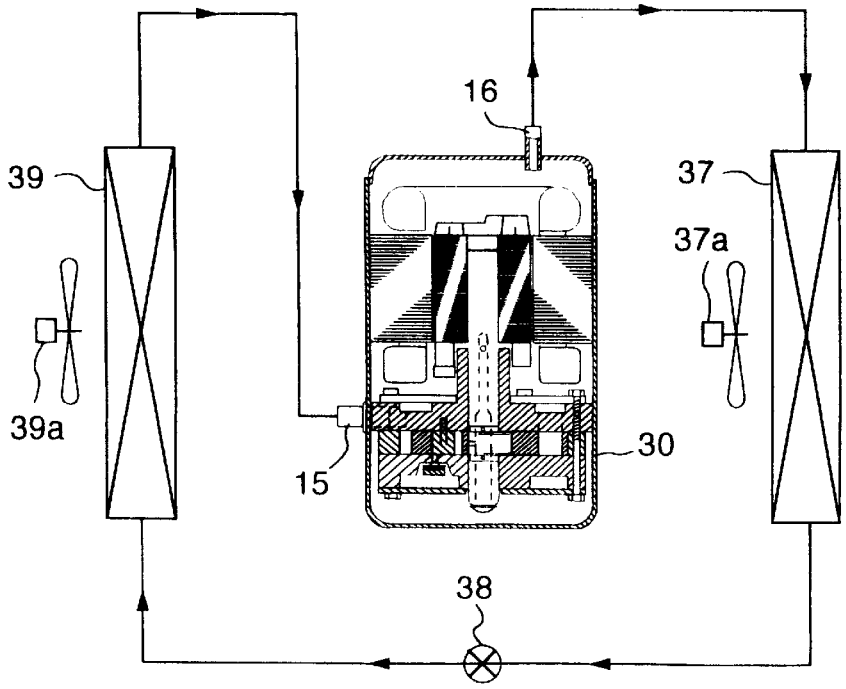
FIG. 23 is an illustration of a refrigerating system employing an orbiting compressor in accordance with the invention.

FIG. 23 shows a refrigerating cycle employing an orbiting compressor of the present invention. This cycle is designed only for refrigeration (cooling) purposes. In this Figure, reference numeral 37 denotes a condenser, reference numeral 37*a* a condenser fan, reference numeral 38 an expansion valve, reference numeral 39 an evaporator, and reference numeral 39*a* an evaporator fan.

When the orbiting compressor 30 is activated, a working fluid is compressed between the cylinder (casing) 4 and the orbiting piston (displacer) 5, and as indicated by solid-line arrows, the compressed working gas of high temperature and pressure flows into the condenser 37 from the discharge pipe 16, and is caused to radiate heat to be liquefied by an air cooling operation by the fan 37*a*, and then is throttled by the expansion valve 38, and is subjected to adiabatic expansion to have low temperature and pressure, and absorbs heat by the evaporator 39 to be gasified, and then is drawn into the orbiting compressor 30 via the suction pipe 15. In each of the systems of FIGS. 22 and 23, the orbiting compressor of the present invention is employed, and therefore there can be obtained the refrigerating, air-conditioning system which is excellent in energy efficiency, low in vibration and noise, and high in reliability. Here, although the above systems, employing the orbiting compressor 30 of the high-pressure type, have been described, a similar function and similar effects can be achieved by the use of an orbiting compressor of the low-pressure type.

In the above embodiments, although the compressors have been described as examples of orbiting fluid machines, the present invention can be applied to a pump, an expander, a power machine and so on. In the present invention, with respect to the form of motion, one member (casing) is fixed or stationary while the other member (displacer) revolves (that is, makes an orbital motion) with a substantially constant orbital radius without rotation. However, the present invention can be applied to the type of orbiting fluid machine in which two members rotate or revolves relative to each other to achieve a form of motion equivalent to the above motion.

Next, a modified displacer 5 in accordance with the invention will be described with reference to FIGS. 24 and 25.

In FIG. 5, the oil grooves 5*b* each having a uniform width throughout the length thereof are formed in the displacer 5. However, it has been found that with this arrangement, the oil film, formed between the displacer and each end plate, becomes uneven.

Explanation will be made with reference to FIG. 3. Referring to the operation chambers 17 formed respectively on the opposite sides of the seal point 10 in FIG. 3A, it will be appreciated that the distance between the outer peripheral surface of the distal end portion of the displacer 5 and the oil groove 5*b* is varying. If the pressure of the oil in the oil groove 5*b* is equal to the pressure in the two operation chambers, the oil film is less liable to be formed on that portion of the surface of the distal end portion of the displacer 5 remote from the oil groove 5*b*. Therefore, the displacer 5 and the end plate are held in metal-to-metal sliding contact with each other at this region where the oil film is not formed, and this causes seizure and wear.

Figure 24:
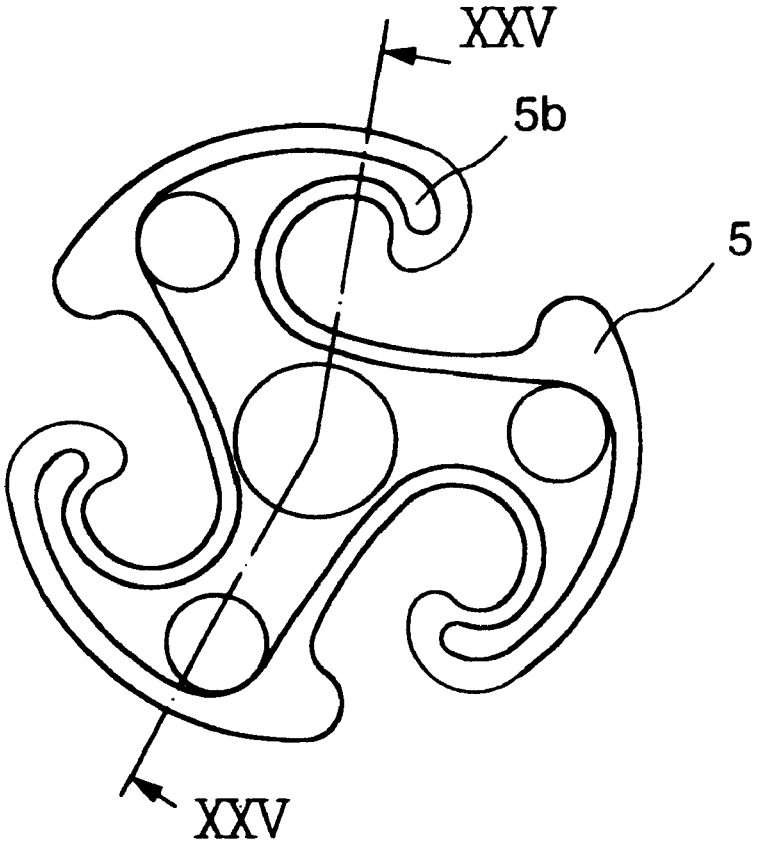
FIG. 24 is a plan view of a modified displacer of an orbiting fluid machine in accordance with the invention.
Figure 25:
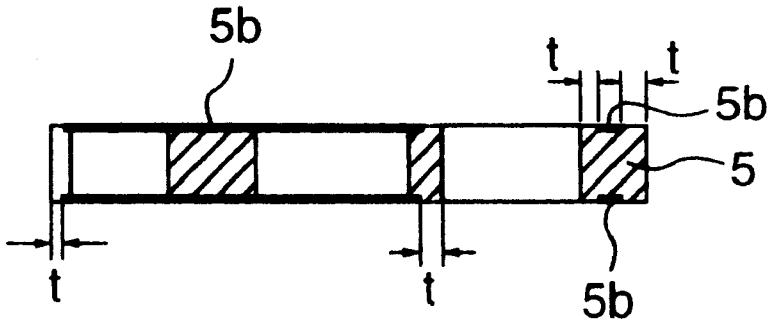
FIG. 25 is a cross-sectional view taken along the line XXV—XXV of FIG. 24.

In the embodiment of FIGS. 24 and 25, an oil groove 5*b* is wider than the oil groove 5*b* of FIG. 5 so that the distance t between the outer peripheral surface of the distal end portion of the displacer (on which the compression pressure acts) and an oil groove 5*b* is substantially uniform, and therefore an oil film is sufficiently formed on the surface of the displacer, thus overcoming the above-mentioned problem. And besides, since the area of the surface of each end plate in contact with the displacer 5 is reduced, a sliding loss can be reduced.

As described in detail, in the present invention, the oil retaining mechanism or the seal mechanism is provided at the displacer which divides the interior of the casing into the plurality of high-pressure and low-pressure operation chambers, and with this construction the axial gaps at the sliding portion of the displacer is effectively sealed, and therefore there can be obtained the orbiting fluid machine of a high performance in which an internal leakage of the working fluid is reduced. By providing this orbiting fluid machine in the refrigerating cycle, there can be obtained the refrigerating-air-conditioning system which has an excellent energy efficiency and a high reliability.

What is claimed is:

1. A displacement fluid machine comprising a displacer and a casing which are provided between end plates, and a drive shaft for imparting an orbiting motion to said displacer, in which, when said displacer is aligned with a rotational center of the drive shaft, one space is formed by an outer peripheral surface of said displacer and an inner peripheral surface of said casing, and when said displacer is set to an orbiting position, a plurality of spaces are formed by the outer peripheral surface of said displacer and the inner peripheral surface of said casing, wherein there is provided an oil feed hole provided in said drive shaft, a groove provided at a surface of said displacer facing at least one of said end plates and connected to said oil feed hole, and a through hole provided in said displacer and passing through a space between the surfaces facing said end plates.

2. A displacement fluid machine comprising a displacer and a casing which are provided between end plates, and a drive shaft for imparting an orbiting motion to said displacer, in which, when said displacer is aligned with a rotational center of said drive shaft, one space is formed by an outer peripheral surface of said displacer and an inner peripheral surface of said casing, and when said displacer is set to an orbiting position, a plurality of spaces are formed by the outer peripheral surface of said displacer and the inner peripheral surface of said casing, wherein there is provided a through hole provided in said displacer and passing through a space between the surfaces of said displacer facing said end plates and an oil feed mechanism for feeding oil to said through hole.

3. A displacement fluid machine according to claim 2, further comprising a groove provided in each of the surfaces of said displacer facing said end plates and connected to said through hole.

4. A displacement fluid machine according to claim 2, further comprising a sealing mechanism for dividing to a high-pressure chamber and a low-pressure chamber in the surfaces of said displacer facing said end plates.

* * * * *